US005188363A

United States Patent [19]

Marnell, II et al.

[11] Patent Number: 5,188,363

[45] Date of Patent: Feb. 23, 1993

[54] WHEEL OF FORTUNE POKER GAME APPARATUS AND METHOD

[75] Inventors: Anthony A. Marnell, II, Las Vegas; Jayme D. Sevigny, Henderson; Cary A. Rehm, Las Vegas, all of Nev.

[73] Assignee: Rio Properties, Inc., Las Vegas, Nev.

[21] Appl. No.: 814,434

[22] Filed: Dec. 30, 1991

[51] Int. Cl.[5] ..... A63F 9/24; A63F 5/00; A63F 1/00

[52] U.S. Cl. ..... 273/85 CP; 273/138 A; 273/142 B; 273/142 HA

[58] Field of Search ..... 273/85 CP, 292, 138 R, 273/138 A, 141 R, 141 A, 142 R, 142 B, 142 H, 142 HA, 460, 144 R, 144 A, 144 B

[56] References Cited

U.S. PATENT DOCUMENTS

| | | | |
|---|---|---|---|
| 2,333,002 | 10/1943 | Goloborodko . | |
| 3,091,388 | 5/1963 | Pace . | |
| 3,272,511 | 9/1966 | Zarich . | |
| 3,735,982 | 5/1973 | Gerfin | 273/138 A |
| 3,796,433 | 3/1974 | Fraley et al. | 273/138 A |
| 3,819,186 | 6/1974 | Hinterstocker . | |
| 3,876,208 | 4/1975 | Wächtler et al. | 273/292 |
| 3,889,956 | 6/1975 | Castle | 273/85 CP |
| 4,017,081 | 4/1977 | Windisch . | |
| 4,052,057 | 10/1977 | Castle | 273/85 CXp |
| 4,560,161 | 12/1985 | Hamano | 273/85 CP |
| 4,560,171 | 12/1985 | Anthony . | |
| 4,848,768 | 7/1989 | Barlow . | |
| 5,014,991 | 5/1991 | Mirando et al. | 273/85 CD |

FOREIGN PATENT DOCUMENTS

| | | | |
|---|---|---|---|
| 543844 | 5/1956 | Italy | 273/138 A |

*Primary Examiner*—Jessica J. Harrison
*Attorney, Agent, or Firm*—Flehr, Hohbach, Test, Albritton & Herbert

[57] ABSTRACT

An electronic game apparatus (21) for play of a poker card game. The apparatus (21) includes a display assembly (22) having a plurality of card spaces (23) each representing one card in a deck of cards, preferably arranged in a wheel of fortune array. A plurality of lights (26) are positioned in the display for individually identifying each of the card spaces (23) upon lighting of the lights (26). Game control apparatus (28) including a random sequence generator (29) electrically connected to momentarily illuminate the lights (26) in a continuing random sequence so that the cards (23) are individually identified one after another in the random sequence. A user actuatable input selection button (33) is electrically connected to the game control (28) for interrupting the continuously random sequence to effect a card selection by continuously lighting the next light (26) to be lit in the random sequence. Poker criteria comparison memory (37) is provided so that selected cards can be compared and awards paid out to the player. Optionally a card discard apparatus (52, 53) can be coupled to the game controller (28). A method of playing a poker game having a wheel of fortune-like display (22) also is set forth.

30 Claims, 1 Drawing Sheet

WHEEL OF FORTUNE POKER GAME APPARATUS AND METHOD

TECHNICAL FIELD

The present invention relates, in general, to an apparatus and method for playing a game of cards. More particularly, the present invention relates to an electronic game or amusement apparatus for playing a game of poker.

BACKGROUND ART

Card games have long provided a source of amusement and entertainment for many people. The several different varieties of poker have been considered by many to be the most exciting of all card games. In most poker games, a number of cards are dealt to several players, with the players competing against one another or the dealer to win the hand. The popularity of poker card games has led to the development of electronic game apparatus which are particularly well suited to enable a card player to play against the game apparatus or machine.

Most casinos, for example, have had electronic draw and blackjack poker apparatus for many years in a format similar to slot machines. Electronic draw poker apparatus will allow individual players to place bets, randomly "draw" cards, discard cards, and draw again to create poker hands. Such draw poker game apparatus will include hand criteria schedules or tables against which each poker hand drawn by a player can be compared. If the predetermined criteria for winning has been met, the poker apparatus will pay out money, or allow the player to make further bets. In conventional electronic draw poker game apparatus a random number generator is used to select among the playing cards, but the player sees only the selected card and cannot affect the card selection other than starting the process.

Another popular form of game apparatus that can be found in casinos is the wheel of fortune game. Most typically, such wheel of fortune games are based upon the use of a large wheel or spinner which is rotated by an employee of the casino and gradually loses its inertia until it stops at one of a plurality of spaces extending around the periphery of the wheel. The spaced are marked, often with representations of money, to indicate what players have won. The wheel of fortune is used in connection with a betting board on which one or more players can place their bets as to the space at which the wheel will stop.

In a wheel of fortune game, however, the players placing the bets cannot operate the wheel since they would learn, with time, the inertia characteristics of the wheel and might be able to influence their betting. Additionally, a wheel of fortune typically will spin for a considerable period of time to make it more difficult to anticipate the space to be selected.

Wheel of fortune gaming apparatus have, as an interesting feature, the excitement and anticipation of the rotating wheel, but they have the disadvantage of requiring an operator, and from the viewpoint of the casino, they are played relatively slowly due to the time required for the wheel to lose its inertia.

Attempts have been made to combine wheel of fortune and poker game apparatus. Once such combination is shown in U.S. Pat. No. 4,560,171. In this patent a poker game is played using a mechanical game apparatus, namely, game boards having spaces marked with representations of cards and associated numbers, together with a wheel of fortune or spinner device for selecting numbers. The cards and numbers are randomly associated with each other and the numbers are randomly distributed about the spinner or wheel. To play the game, each player marks the space on his or her game board which corresponds to the number generated by spinning the wheel of fortune device. After the players mark the space, the number spinner is again spun, and play proceeds until a poker hand has been drawn. In this type of apparatus, however, in addition to being cumbersome and bulky by reason of the multiplicity of game boards and separate spinner, play is again relatively slow. Moreover, if the game player can control spinning of the apparatus there will be a learning effect since the sequence on the wheel is finite and cyclical. To minimize this effect, players can be forced to change cards so as to change the number association with the cards, but this solution also is cumbersome.

Other wheel of fortune game apparatus have employed number or space selection wheels that are rotated by motors or the like and allowed to slow to make the space or number selection. Typical of these devices are U.S. Pat. Nos. 2,333,002, 3,091,388, 3,272,511 and 4,848,768. In each of these cases, however, the number sequence in cyclical or reoccurring, even if the numbers are not in any logical order. A player who controls the actuation and de-actuation or coasting of the wheel, therefore, can have some effect on the approximate number or space which is selected by the wheel. For the most part, therefore, such devices are not well suited for unsupervised gaming machines.

Finally, electronic random selection devices have been devised for wheels of fortune and for roulette-type games. U.S. Pat. Nos. 4,017,081 and 3,819,186 are typical of such devices. While solving to various degrees the problem of learned anticipation, such electronic number selection devices have not been adapted for use with a poker game or, more specifically, a poker game having some of the visual excitement of a wheel of fortune game. Moreover, these electronic number selection devices essentially operate by having the user switch them on, after which the number selection is effected entirely by the electronic circuits. Thus, the fun of user input or selection is not present once the selection process is set into motion.

Accordingly, as an object of the present invention to provide an electronic game apparatus for the play of a poker game which has the visual excitement of a wheel of fortune game with the feature of user input for card selection.

Another object of the present invention is to provide a wheel of fortune poker game apparatus in which the user has input into and participates in the play of the game but cannot learn or anticipate the cards which will be selected.

A further object of the present invention is to provide an electronic game apparatus which is entertaining to play, can be played in a relatively short period of time and provides the player with a strong feeling of anticipation and excitement during play.

The electronic game apparatus of the present invention has other objects and features of advantage which will be set forth in more detail in the Best Mode of Carrying Out The Invention and will be apparent from the accompanying drawing.

DISCLOSURE OF THE INVENTION

The electronic game apparatus for play of a card game, such as poker, of the present invention is comprised, briefly, of a display assembly having a plurality of visually perceptible card representations forming a deck of cards, card identification means electrically connected to the display assembly and formed for selective identification, for example by lighting, individual card representations; a controller electrically connected to the identification means and producing intermittent identification of the card representations in a continuing random sequence; and a user-actuatable input device electrically connected to the controller. The controller includes means preventing user anticipation of the occurrence of card sequencing and the controller is responsive to actuation of the input device to interrupt the random sequence by identifying the next card representation in the random sequence to thereby "select" or "draw" a card for a hand in the play of the card game. In the preferred form the identification means is provided by a plurality of lights proximate each card representation, and the controller means includes a random sequence generator to momentarily light each of the lights in a continuing random sequence that is randomized at the start of each game and played under a time constraint or is repeatedly re-randomized to prevent user card anticipation. Upon user input, the sequence is terminated and the light for the next card in the random sequence is illuminated and remains illuminated. The random sequencing of card representations then continues, without the selected card, and the user can again input to interrupt the sequence and select a card. Once the hand has been selected by the user, it is compared to poker criteria established for the game and a payout or award is made available to the player if the hand meets the poker criteria.

BEST MODE OF CARRYING OUT THE INVENTION

Figure 1:
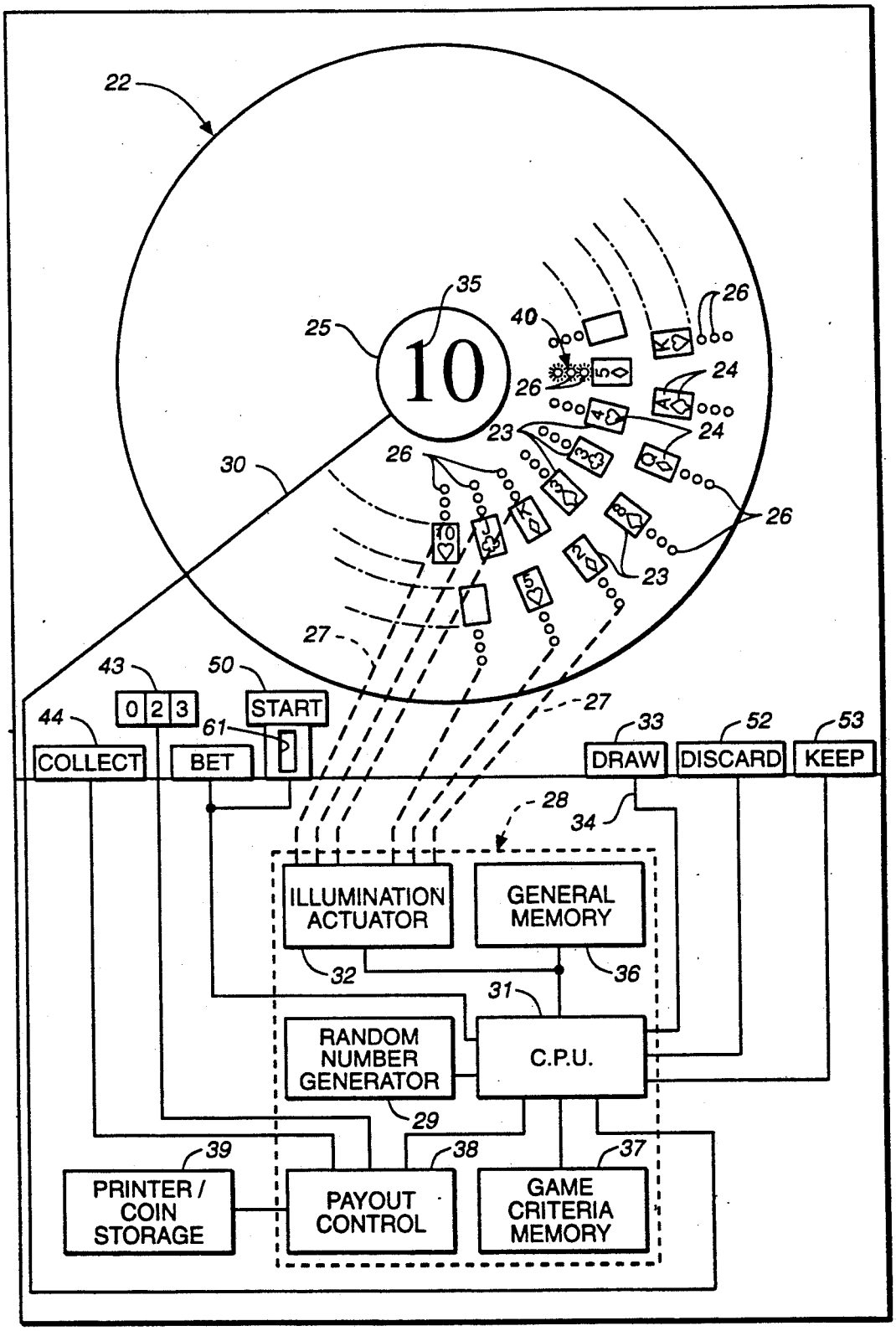
FIG. 1 is a front elevation view of a schematic representation of an electronic game apparatus constructed in accordance with the present invention.

The electronic game apparatus of the present invention combines the visual excitement of a wheel of fortune with the complexities, nuances and entertainment value of a poker game. Thus, as may be seen in FIG. 1, game apparatus, generally designated 21, of the present invention includes a display assembly, generally designated 22, having a plurality of visually perceptible card representations 23 thereon forming a deck of cards. Usually the deck will be a conventional poker deck including fifty-two cards, but it will be understood that card representations 23 also can include one or more jokers or wild cards. Each card representation or space 23 typically will include indicia 24 identifying the particular space as one of the cards in a conventional deck of cards.

Mounted to display assembly 22 is card identification means formed for selective identification of individual card representations 23 in the deck of cards. In the most preferred form, the card identification means is provided by illumination means in the form of a plurality of lights 26 electrically connected by conductors 27 to an illumination actuator 32 forming part of a controller, shown bounded by broken lines and generally designated 28. In a manner more fully described below, controller 28 is formed to produced intermittent identification of each of card representations or spaces 23 in a continuing random sequence. In the preferred form, such identification is achieved by illuminating lights 26, which are here shown as a line or spoke of three lights proximate card spaces 23. Thus, each time a line or spoke of lights 26 is illuminated a card is identified, and controller 28 causes the three-light lines or spokes to be lighted in a random order or sequence one after another to "identify" card representation 23 associated with the illuminated line of lights.

In the form of the invention illustrated in FIG. 1 card representations 23 can be formed of translucent material and continuously back lighted for easy viewing. Alternatively, however, lights 26 can be provided by a light positioned behind each card representation 23 or even within spaces 23. Thus, each card space would be normally not lighted and then momentarily illuminated. Additionally, and particularly in slot machine size or formatted gaming apparatus display assembly 22 can be produced on a video display by a card image generator, and identification means, such as, images or indicia, can be used to identify the card representations or card images.

While there are a finite number of cards in any deck of cards, controller 28 of the present invention effects a continuing random sequence of card representation identification, while preventing user anticipation of the next card. In the preferred form controller 28 uses a combination of a random "shuffle" of the cards and starting point at the start of each game, plus very short interval of illumination (for example, 0.15 seconds), plus a finite short time in which to select (for example, 10 seconds).

Controller 28, therefore, includes a random number generator. 29 coupled to a microprocessor or central processing unit (C.P.U.) 31, which in turn is coupled to illumination actuator 32. When a start signal is received by C.P.U. 31, the C.P.U. instructs number generator 29 to create a random series or string of numbers, for example, of the numbers 1–52. C.P.U. 31 or actuator 32 includes correlation means in which each number is correlated to one of card representations or spaces 23. This randomizing of the numbers at the start of the game is equivalent to a shuffle of the cards.

Once "shuffled" C.P.U. 31 actuates a count-down timer display 25 through conductor 30. Numbers 35 begin to count-down, for example, from 10 to zero in one second intervals. At the same time as the count-down has begun on display 25, illumination actuator begins randomly illuminating lines of lights 26 in accordance with the number order generated by generator 29. Each line of lights, however, is illuminated for only 0.15 seconds or 6.67 cards are identified per second. In 10 seconds, therefore, only 67 cards will be identified, which is only slightly more than once through the deck.

The player must select a predetermined number of cards (usually 5 cards) in a manner described in more detail below, within the 10 seconds, and if he or she fails to select all of the predetermined number, the unselected cards will be automatically selected by the C.P.U. as the next cards in the sequence at the end of the 10 second count-down.

By providing a short time constraint, e.g., 10 seconds, and by identifying cards randomly at a high rate, for example, at least 5 cards per second, the player is prevented from anticipating the next card to be identified.

When a time constraint system is provided, a start signal received by controller 28 can be used to cause the lines of lights 26 to be sequentially illuminated in a clockwise direction. When the start illumination sequence reaches 12:00 o'clock, timer display 25 will start counting down numbers 35 and user-actuatable input select means or "draw" button 33 will be enabled. The visual start sequence again simulates the rotation of a wheel or sweeping of a clock hand which adds to player anticipation and entertainment. Moreover, such sweeping of lines of lights 26 can be used to provide an "attract mode" for game apparatus 21 when the apparatus is not being played.

Alternatively, controller 28 also can prevent player anticipation of cards by periodically "reshuffling" the deck during play, rather than employing a time constraint. Thus, controller 28 can be formed to shuffle the cards (generate a random number string by means of generator 29), and produce an intermittent random sequence of lighting of card representations 23 (through C.P.U. 31 and illumination actuator 32). A predetermined number of the random sequence of numbers would be displayed, for example, the first 40 of the 52 cards spaces would be identified by lighting. Then, a new random number sequence reshuffling would be generated by number generator 29 (excluding any number (card) that had been selected), and the display or intermittent lighting of cards would continue.

This approach of reshuffling the cards allows the player to select cards over any convenient period of time without enabling the player to anticipate cyclical card identification patterns.

The effect, as thus far described, is to produce a random momentary lighting or identification of card representations 23 around the wheel or display 22 so that a visual wheel of fortune effect is simulated. As will be appreciated, however, lighting of lights 26 does not proceed sequentially around the periphery of display 22, although that would be theoretically statistically possible. Instead, the lights on display 22 tend to jump from one location to another across and around the circular display. Since display assembly 22 as illustrated has two rings of card representations with associated lines of lights 26 both inside and outside the two rings, light illumination also jumps from one ring of lights to another. It will be apparent, however, that display assembly 22 could also take the form of a rectangular or other array of card spaces or representations 23. Moreover, the indicia 24 identifying each card can be either in numerical and suit sequence or can be random around the array. In the preferred form illustrated in FIG. 1, the card representations are arranged in a random sequence around the two rings of cards.

It is an important feature of the game apparatus of the present invention that the apparatus include user-actuatable input means 33 electrically connected to control means 28. Control means 28 is responsive to actuation of input means 33 to interrupt the random sequence being generated by generator 29 and displayed by actuator 32 to identify a particular card representation in the random sequence to thereby select or "draw" cards for a hand in the play of a card game. As will be seen in FIG. 1, therefore, a "draw" button 33 is electrically connected by conductor means 34 to C.P.U. 31. A user input signal is generated by depressing draw button 33, and once received by the C.P.U. 31 interrupts the display of the continuing random card sequence to select either the card being identified at the instant of the input or the next-in-time random number or card after actuation of input device 33. The user selected card or number is then illuminated by actuator 32 and the controller causes the actuator to hold or maintain illumination of the selected line of light 26. On display assembly 22, therefore, a line of lights 26 will remain continuously lit, for example, line 40 of lights 26 associated with the card representation for the five of diamonds.

After the selection process has been completed, the C.P.U. will continue to pass random numbers to illumination actuator 32 so that intermittent or momentary lighting of lights 26 in a continuing random sequence will resume. Once the random sequence is resumed, user input device 33 is enabled by C.P.U. 31, and the user can again interrupt the random sequence at any time by pushing "draw" button 33 to select the next card representation 23, which is identified again by continuous illumination of an associated line of lights 26. The process proceeds until a hand of cards is selected or drawn, or until timer 26 reaches the end of its time interval, at which point the next in random order of the cards are selected by controller 28 to complete the hand.

One form of poker game that can be played using the apparatus of the present invention is simply a five or a seven card draw game. In a five card draw game the user selects five cards to make the hand. As cards are selected, the card selections are stored in general memory 36 and are compared by C.P.U. 31 against stored poker hand winning criteria, for example, as stored in game criteria memory 37. As is common for conventional poker apparatus, game criteria memory 37 can select a plurality of hands as winning hands, with the value of the winning hands varying with the statistical likelihood of their occurrence. Usually there is a graduated scale which can range, for example, from a pair of jacks or better to a royal flush, with correspondingly graduated increasing payouts.

In seven card draw, or even nine card draw hands, the best or highest five card poker hand of the seven or nine cards selected is compared to the game criteria memory for the purpose of making monetary payouts or making awards. Thus, if there is a match found by C.P.U. 31 between the selected hand in memory 36 and predetermined game criteria hands in memory 37, the C.P.U. can signal payout control 38 to enable "bet" button 42 and "collect" input button 44 and increment coin counter 43. If the player pushes collect button 44, payout control 38 will print a winning coupon or to pay money from printer/coin storage device 39. If the player pushes bet input button 42, the player can place a bet on the new game, which is started by pushing "start" button 50 after the bet has been made.

Since one of the most widely played poker games is draw poker, either high or low, it is further desirable for game apparatus 21 to include a card discard assembly, which may include a "discard" button 52 and "keep" button 53. Both discard and keep buttons 52 and 53 are user actuatable and electrically connected to controller 28.

After a hand of five cards is selected, C.P.U. 31 will stop the intermittent sequencing of the lights, leaving the five selected lines of lights lit. The C.P.U. will then enable discard assembly by causing the discard button 52 and the keep button 53 to be activated. Additionally, microprocessor 31 will cause a first of the five selected cards or lines of lights to be identified for a discard, for example, by causing lights 26 to begin blinking. The user can then press discard button 52 or keep button 53 to thereby discard or keep the card representation identified by the blinking line of lights. If the card is discarded, illumination of two of the three lines of lights will cease, and if it is kept, illumination of all lights in the line will become constant. Usually, however, the player will be given the option to change his or her mind by canceling a discard to reinstate the card to the hand before the draw is made. This discard and keep process continues sequentially around the five cards until a decision to discard or keep all five cards has been made. Microprocessor 31 will return to the first card and allow the user to cancel a discard by hitting discard button 52 again or pressing keep button 53. Thus, the C.P.U. will give the player the ability to discard, keep or cancel the cards in the hand by stepping sequentially around the hand until the player is satisfied with the hand, at which point the player hits draw button 33.

If there are any cards discarded, after the final discard/keep decision has been made, the C.P.U. will again actuate random number generator 29 and begin displaying an intermittent random card lighting sequence. Discarded cards, however, will not be lost from memory 36 and they will remain removed from the deck when number generator 29 reshuffles or generates a new random number sequence. The player may then draw cards to replace those that have been discarded. The draw will again be under a time constraint by resetting timer display 25, or subject to periodic reshuffling. At the end of this draw process, or at the end of the discard/keep process if all cards are kept, the selected cards in memory 36 are compared against game criteria memory 37 to determine the payout of awards or money to the game player.

Game apparatus 21 is preferably in the general format of a slot machine and includes input coin or token receptacle 61 dimensioned for receipt of coins or tokens. Conventionally, the player can insert one or more coins or tokens with the result that the payout schedule or table for a given hand increases with the number of coins bet. Similarly, bet input button 42 can be used to bet one or more coins up to a maximum to thereby change the payout produced upon the occurrence of a given hand. Such coin input, betting and payout assemblies are all well known in prior electronic game apparatus and do not form a novel portion of the present invention.

The method of the present invention, therefore, for playing a poker game comprises the steps of individually illuminating card space 23 one after another in a continuing random sequence with each card representation being momentarily lit during the continuously random sequence; and actuating a user input selection device 33 to interrupt the random sequence and thereby select the next card representation as being one card in the poker hand by lighting the selected one of the card representations continuously. The method further includes the step of resuming individual momentary illumination of card representations 23 after the step of actuating user input selection device 33, as well as the further step of actuating user input selection device 33 again to interrupt the random sequence and make a second card selection. In a preferred method, the actuating step is repeated five times to select five card representations for the hand, and after a poker hand is selected it is compared against at least one predetermined poker hand criteria for the provision of an award in the event of the occurrence of the criteria for poker hands. Optionally, the method of the present invention also includes the steps of discarding selected ones of the cards for the poker hand by deactivating the continuous lighting of card representations, resuming a random sequence of momentary lighting of cards and then actuating user input selection device 33 to again select a new card representation.

As will be apparent from the above description, therefore, game apparatus 21 allows the play of poker games in which the user actively physically participates by input to the game apparatus, and visually the poker card selection process has the excitement of a wheel of fortune. The game apparatus is constructed in a manner preventing player anticipation of learning of card sequences which would allow the player to affect the randomness of play of the game machine. Moreover, once the user hits the draw or card selection button 33, the game apparatus instantaneously makes a random card selection. Thus, the game can be played relatively rapidly, particularly if played under a time constraint, and yet exciting visual effects will take place during play of the game apparatus.

The electronic components assembled in the game apparatus of the present invention are all broadly known in other electronic game apparatus, and no single component is regarded as being a novel portion of the present game apparatus but, rather, the combination of electronic components which produce the game play value of the game apparatus 21 is regarded as novel.

What is claimed is:

1. An electronic game apparatus for play of a poker game comprising:

(a) a display assembly having a plurality of visually perceptible card representations arranged in a substantially circular array on said display assembly to concurrently display each card contained in a deck of cards;

(b) a plurality of lights mounted on said display assembly with at least one of said lights positioned adjacent each of said card representations for selective identification of individual card representations;

(c) control means electrically connected to said plurality of lights and producing intermittent identification of each of said card representations by momentary lighting of each of said lights in a continuing random sequence, said control means preventing user anticipation of the occurrence identification of a particular card representation; and (d) user-actuable input means electrically connected to said control means, said control means being responsive to actuation of said input means to interrupt said random sequence by identifying a particular card representation in said random sequence to thereby select a card for a hand in the play of said poker game.

2. The electronic game apparatus as defined in claim 1 wherein, said control means includes correlation means correlating each card identity with each light adjacent said card representations, and said control means includes a random number generator formed to produce momentary lighting of each of said lights in said random sequence to provide intermittent random identification of each of said card representations.

3. The electronic game apparatus as defined in claim 2 wherein, said control means is further responsive to actuation of said input means by said user to continuously light the next light in said random sequence to be lighted after user actuation of said input means.

4. The electronic game apparatus as defined in claim 3 wherein, said control means is formed to resume momentary lighting of said plurality of lights, except the continuously lighted light, in said random sequence after interruption by said input means.

5. The electronic game apparatus as defined in claim 4 wherein, said control means is responsive to further interruption by user actuation of said input means to continuously light additional lights to identify additional card representations and to resume momentary lighting of a remainder of said plurality of lights in said random sequence until a predetermined number of card representations have been identified.

6. The electronic game apparatus as defined in claim 5 wherein, said control means includes user actuatable start input means electrically connected to begin said random sequence of momentary lighting of said plurality of lights;

said card representations include card representations for a deck of fifty-two playing cards;

said control means includes game criteria means electrically connected to said control means for comparison of card representations selected by user input against predetermined criteria for winning of a poker game; and payout means electrically connected to said control means and responsive to the occurrence of a winning hand to enable payout of an inward to the user.

7. An electronic game apparatus for play of a card game comprising:

(a) a display assembly having a plurality of card spaces each representing one card of a deck of cards, said card spaces being arranged on said display assembly in a substantially circular array and being distributed about the circle in random order;

illumination means including a plurality of lights positioned on said display assembly in a circular arrangement concentric with the circle formed by said card spaces so that at least one of said plurality of lights is positioned adjacent each of said card spaces for individually identifying each of said card spaces upon lighting thereof;

(c) game control means including random number generator means formed to generate a random series of numbers and card space correlating means electrically connected to correlate said numbers to said card spaces, said control means further electrically connected to said illumination means and controlling momentary lighting and subsequent unlighting of each of said plurality of lights in a continuing random sequence to momentarily individually identify each of said card spaces one after another in a random sequence, said control means including means preventing player anticipation of the random sequence; and (d) user-actuable input selection means electrically connected to said game control means and interrupting said continuing random sequence by continuously lighting one of said plurality of lights to select at least one of said card spaces for a hand from said deck.

8. The electronic game apparatus of claim 7 wherein, said control means is formed to resume said continuing random sequence after card selection, with the selected ones of said card spaces being excluded from identification during said random sequence; and said input selection means being formed to repeatedly interrupt said continuing random sequence to select others of said card spaces for said hand until a predetermined number of said card spaces have been selected.

9. The electronic game apparatus of claim 8 wherein, said predetermined number of card spaces is at least five.

10. The electronic game apparatus of claim 7, and user-actuatable input discard means electrically connected to said illumination means for deactivating the continuous lighting of the selected ones of said card spaces, said input select means being responsive to deactivation of the continuous lighting by said input discard means to be activated for user selection of at least one new card space.

11. The electronic game apparatus of claim 7, and game criteria means electrically connected to said control means and having at least one predetermined hand criteria, said game criteria means being formed for comparing the selected ones of said card spaces of said hand with said at least one predetermined hand criteria.

12. The electronic game apparatus of claim 11, and payout means electrically connected to said control means and responsive to the occurrence of said at least one predetermined hand criteria in said hand to provide for the payout of an award to the user.

13. The electronic game apparatus as defined in claim 7 wherein, said means for preventing player anticipation of the random sequence is provided by time constraint means.

14. The electronic game apparatus as defined in claim 13 wherein, said time constraint means is provided by momentarily lighting identifying lights at a high rate relative to the number of cards in a deck and by enabling said user-actuatable input selection means for a sufficiently short time period to prevent learned observation of identification cycles.

15. The electronic game apparatus as defined in claim 14 wherein, said time constraint means lights identifying lights at a rate of at least 5 card representations per second and enables said user-actuatable input selection means for not more than about 10 seconds.

16. The electronic game apparatus as defined in claim 14 wherein, said control means automatically selects the next cards in the random sequence if a complete hand has not been selected at the end of the time period of enabling of said user-actuatable input selection means.

17. The electronic game apparatus as defined in claim 7 wherein, said means for preventing player anticipation of the random sequence is provided by said control means causing said random number generator means to periodically generate a new series of random numbers at sufficiently frequent intervals to prevent anticipation of card selection.

18. The electronic game apparatus as defined in claim 17 wherein, said random number generator generates a new series of random numbers before all numbers in the previous series have been displayed.

19. An electronic game apparatus as defined in claim 7 wherein, said card spaces are arranged on said display in two concentric circles, and said plurality of lights are positioned on said display along the inner perimeter of the innermost circle and along the outer perimeter of the outermost circle to provide the effect of illuminating circles of lights.

20. An electronic game apparatus as defined in claim 19 wherein, said plurality of lights is provided by a plurality lines of lights positioned adjacent each of said card spaces.

21. An electronic game apparatus as defined in claim 20 wherein, each of said plurality of lines of lights includes three LEDs in radial alignment with respect to the center of said display assembly.

22. An electronic game apparatus as defined in claim 7 wherein, said display assembly includes fifty-two card images with each of said card images designating one of the cards in a deck of at least fifty-two cards.

23. A method for playing an electronic game of poker on a poker game apparatus by the simulated drawing of a predetermined number of cards for a poker hand from a deck of cards, said method for playing said game comprising the steps of:

(a) providing a display assembly having a plurality of card representations each depicting one card of a deck of cards and also having at least one light positioned adjacent each of said card representations for selective identification of individual card representations, said card representations being arranged in random order on said display assembly in a substantially circular array;

(b) identifying and illuminating individual ones of said card representations one after another in continuing random sequence, said card representations being identified by momentary lighting of said lights adjacent said card representations during said continuing random sequence; and (b) actuating a user input selection device to interrupt said continuing random sequence and thereby select an identified card representation as being one card in the poker hand and the selected one of said card representations being lit continuously.

24. The method of claim 23 wherein, after said actuating step, resuming the individual momentary illumination of said card representations in said continuing random sequence, and thereafter actuating said user input selection device again to interrupt said continuing random sequence and select another of said card representations for said hand until a predetermined number of said card representations have been selected.

25. The method of claim 24 wherein, said actuating step is repeated five times to select five card representations for said hand.

26. The method of claim 23, and the step of:

after a hand is selected, comparing the selected ones of said card representations with at least one predetermined pocket hand criteria.

27. The method of claim 26 wherein, after said comparing step, providing an award for the user of said game apparatus on the occurrence of said at least one predetermined hand criteria in said hand.

28. The method of claim 23 and the step of:

discarding a selected one of said card from said poker hand by deactivating the continuous lighting of card representations of the selected one of said card representations;

resuming a continuing random sequence of illumination of card representations; and thereafter actuating said user input select device again to select a new card representation.

29. The method of claim 23, and the step of:

enabling said actuating step for a short time duration to force selection before said random sequence can be learned by the player.

30. The method of claim 23, and the step of:

periodically starting a new random number sequence before the sequence can be learned by the player.

* * * * *

UNITED STATES PATENT AND TRADEMARK OFFICE

CERTIFICATE OF CORRECTION

PATENT NO. : 5,188,363

DATED : February 23, 1993

INVENTOR(S) : Anthony A. Marnell, II, et al.

It is certified that error appears in the above-identified patent and that said Letters Patent is hereby corrected as shown below:

Column 9, line 36, claim 6, delete "inward" and insert ---award---.

Signed and Sealed this

Twenty-second Day of February, 1994

Bruce Lehman

*Attest:*

BRUCE LEHMAN

*Attesting Officer*

*Commissioner of Patents and Trademarks*